US008789245B2

(12) United States Patent
Leger

(10) Patent No.: US 8,789,245 B2
(45) Date of Patent: Jul. 29, 2014

(54) EXTENSIBLE CLASP FOR A WRIST STRAP IN PARTICULAR OF A WATCH

(75) Inventor: Georges Leger, Marignier (FR)

(73) Assignee: GLW SA (CH)

( * ) Notice: Subject to any disclaimer, the term of this patent is extended or adjusted under 35 U.S.C. 154(b) by 0 days.

(21) Appl. No.: 13/979,148

(22) PCT Filed: Sep. 23, 2011

(86) PCT No.: PCT/IB2011/002235

§ 371 (c)(1),
(2), (4) Date: Jul. 11, 2013

(87) PCT Pub. No.: WO2012/095686

PCT Pub. Date: Jul. 19, 2012

(65) Prior Publication Data

US 2013/0286797 A1 Oct. 31, 2013

(30) Foreign Application Priority Data

Jan. 13, 2011 (CH) ..... 0068/11

(51) Int. Cl.
*A44C 5/18* (2006.01)
*G04B 37/16* (2006.01)

(52) U.S. Cl.
USPC ..... 24/71 J; 24/265 WS

(58) Field of Classification Search
USPC .... 24/265 WS, 265 EC, 71 J, 265 BC, 70 ST, 24/68 E, 70 J, 906; 224/171, 164, 174, 178, 224/176, 177
See application file for complete search history.

(56) References Cited

U.S. PATENT DOCUMENTS

| | | | | |
|---|---|---|---|---|
| 1,893,271 | A * | 1/1933 | Carlson | 24/71 J |
| 2,596,186 | A * | 5/1952 | Volk | 24/71 J |
| 3,478,537 | A * | 11/1969 | Berr et al. | 63/4 |
| 3,699,616 | A * | 10/1972 | Kalinsky | 24/71 J |
| 8,001,658 | B2 * | 8/2011 | Christian et al. | 24/71 J |
| 2013/0160255 | A1 * | 6/2013 | Schmidt et al. | 24/71 J |

FOREIGN PATENT DOCUMENTS

JP 7 289316 11/1995

* cited by examiner

*Primary Examiner* — Robert J Sandy
*Assistant Examiner* — Rowland Do
(74) *Attorney, Agent, or Firm* — Galbreath Law Offices, P.C.; John A. Galbreath

(57) ABSTRACT

An extensible clasp or buckle for a wrist strap, which makes it possible to control the length of the wrist strap. The clasp has a first and a second strip which are articulated to one another at a first end, and a first tie which is arranged at a second end of the first strip for connection to a first strand of the wrist strap. The clasp also has a second tie which is arranged at a second end of the second strip for connection to a second strand of the wrist strap, and a way to displace the second tie with respect to the end of the second strip in order to adjust the length of the wrist strap. The second tie is connected to a cradle which is arranged in a housing located on the second strip. The housing has two opposite walls along which the cradle can slide. The clasp also has a tab which is connected to the second strip and arranged so as to cooperate with the cradle. The tab is able to occupy two axial positions so that the cradle is locked and unlocked when the tab is positioned in one or the other of the two axial positions.

7 Claims, 2 Drawing Sheets

EXTENSIBLE CLASP FOR A WRIST STRAP IN PARTICULAR OF A WATCH

Figure 1:
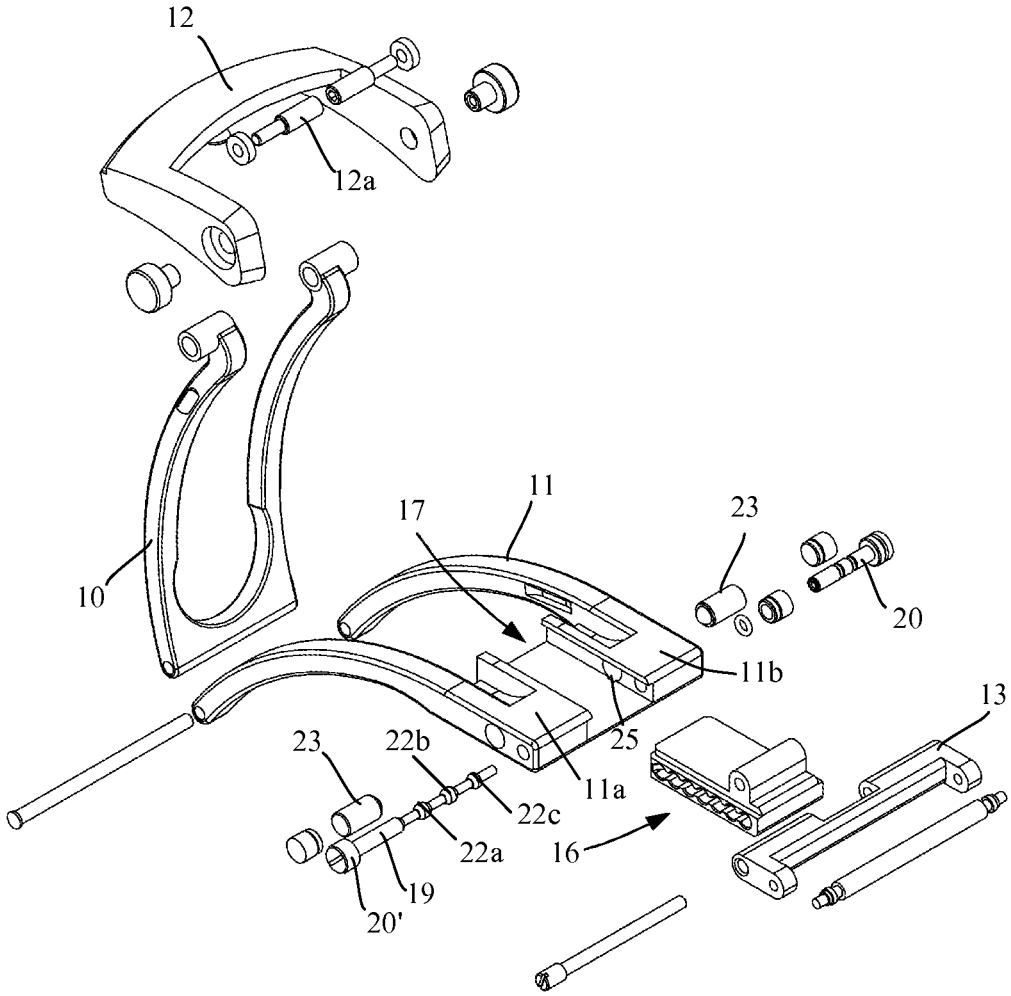

The present invention relates to the field of wrist straps, in particular for watches. More particularly, it relates to a wrist strap clasp comprising an extensible buckle making it possible to control the length of the wrist strap precisely.

Clasps comprising an extensible buckle are well known for the aesthetic appearance thereof. These clasps are often associated with wrist straps formed of links. In this case, the length of the wrist strap is generally adjusted by the retailer by adding or removing one or more links as a function of the wrist size of the wearer. This adjustment is generally definitive and does not take into account the differences in the circumference of the wrist as a function of ambient heat and/or depending on the strain exerted by the wearer. However, it is found that the need to make an adjustment of this type is encountered frequently, since the dimensions of the wrist change depending on how low or high the ambient temperature is. Without the possibility of adjustment, the wrist strap can squeeze the wrist at hot summer temperatures. By contrast, in winter, the same strap has a tendency to turn around the wrist.

There are a plurality of watch straps provided with a system making it possible for the wearer of the watch to adjust the length of the wrist strap himself by just a few millimeters, depending on the circumstances. Clasps of this type are disclosed in particular in publications U.S. Pat. No. 5,927,577, JP59108411, EP1716776, EP1378185, EP1943917, EP1920673 and also WO2008064931.

By way of example, the device disclosed in publication U.S. Pat. No. 5,927,577 comprises an end fitting, one of the ends of which is articulated to an end of one of the strands of the wrist strap, the other end of the end fitting being equipped with a rod which can be positioned inside a cover in different holes arranged along the lateral edges thereof. The major drawback of this device stems from the fact that the clasp has to be opened so as to adjust the length of the wrist strap.

JP59108411 relates to a clasp for an extensible buckle comprising two strips, comprising a first and a second strip which are articulated to one another at a first end and a hood which is articulated to a second end of the first strip, the hood being linked to a first strand of the wrist strap. A substantially rectangular opening extends along the longitudinal axis of the second strip. The longitudinal edges of this opening are provided with a notched part arranged so as to cooperate with blocking means, which are integral with a support of the extensible buckle, the support being linked to a second strand of the wrist strap. The blocking means comprise two blocking elements for positioning in one of the notches of each notched part of the opening of the second strip so as to block it in a desired indexed position with respect to the strip support. The blocking means further comprise a push-button, the actuation of which makes it possible to disengage each blocking element of the corresponding notched part so as to be able to adjust the length of the wrist strap. Each blocking element is subsequently positioned in another one of the notches on each of the two notched parts when the push-button is no longer being actuated so as to block the second strip in a different indexed position with respect to the strip support. Just as in publication U.S. Pat. No. 5,927,577, the clasp has to be opened so as to adjust the length of the wrist strap, and this complicates handling.

EP1716776 discloses a device for controlling the length of a watch strap which has the aim of overcoming in particular the problem addressed above. This device comprises a cover, inside which an end fitting can slide which is articulated to one end of the wrist strap. This end fitting comprises means for pre-positioning and blocking in position, which cooperate with a disconnection system, making it possible to control the length of the wrist strap without being required to open said wrist strap. In accordance with the teaching of EP1716776, this control device is to be mounted on rigid wrist straps comprising links, or the ends are attached to a clasp comprising unfoldable articulated strips. This device is therefore not suitable for wrist straps made of leather or another flexible substance of which one of the strands is to be arranged in a slide loop assembly provided with a tongue for approximately adjusting the length of the wrist strap.

Publication EP1378185 proposes a clasp comprising an extensible buckle having two strips which solves the problems addressed above. The two strips of this clasp are articulated to one another at one of the ends thereof, whilst the other of the ends thereof is connected respectively to a hood connected to one of the strands of a wrist strap and to a movable end fitting connected to the other of the strands of the wrist strap. The movable end fitting is arranged inside a receptacle within which indexing means for controlling the length of the wrist strap are mounted. These indexing means comprise two blocking elements which are arranged so as each to cooperate with a notched part in the form of saw teeth located along the internal lateral flanks of the receptacle. Two push-buttons arranged on the external lateral flanks of the receptacle make it possible, when they are actuated, to disengage the blocking elements from the notched parts so as to be able to control the length of the bracelet.

The object of the present invention is to propose a different version of an extensible clasp for a wrist strap, which has the advantage of offering precise control of the length of the wrist strap when the clasp is in the closed position and which can easily be adapted so as to be mounted on a wrist strap comprising links or made of leather.

According to the invention, this object is achieved by virtue of a clasp comprising an extensible buckle for a wrist strap making it possible to control the length of the wrist strap, said clasp comprising: a first and a second strip which are articulated to one another at a first end; a first tie which is arranged at a second end of the first strip for connection to a first strand of the wrist strap; a second tie which is arranged at a second end of the second strip for connection to a second strand of the wrist strap; and indexing means so that the second tie can occupy different indexed positions with respect to the end of the second strip. The second tie is connected to a cradle which is arranged in a housing located on the second strip. The housing comprises two opposite walls along which the cradle can slide. The clasp further comprises a tab which is connected to the second strip and arranged so as to cooperate with the cradle, the tab being able to occupy a first and a second axial position in such a way that the cradle is locked and unlocked when the tab is located respectively in one and the other of the two axial positions thereof.

The features of this clasp make it possible to control the length immediately, comfortably and precisely, whilst benefitting from a simple, aesthetic and reliable construction.

Figure 2:
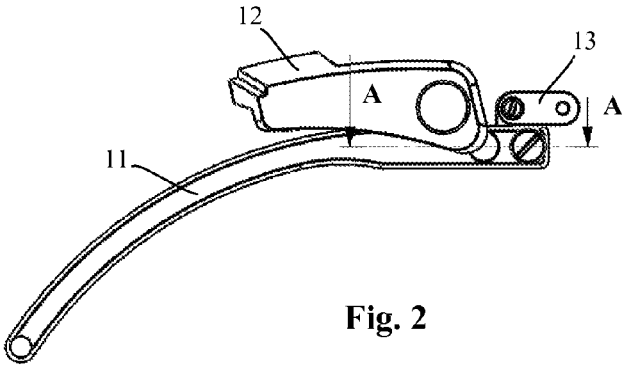
Figure 3:
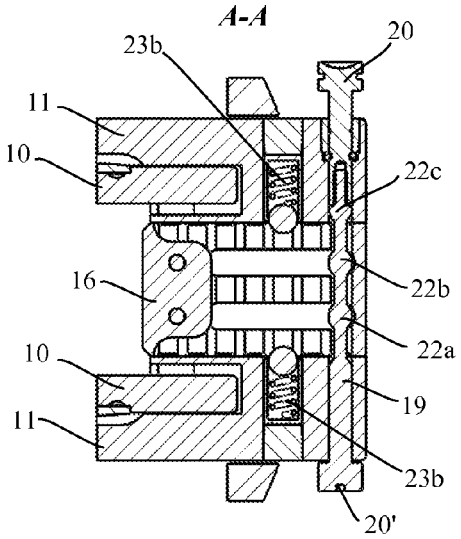
Figure 4:
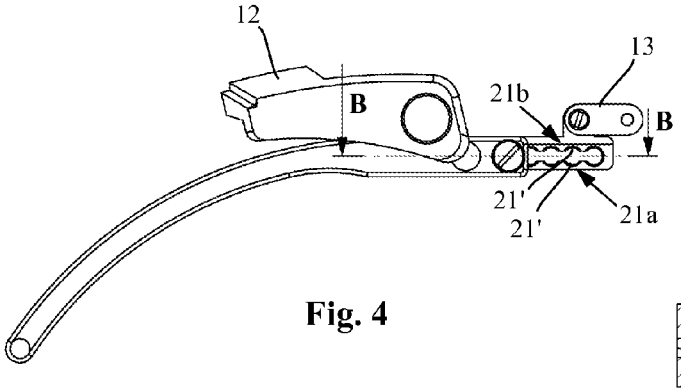
Figure 5:
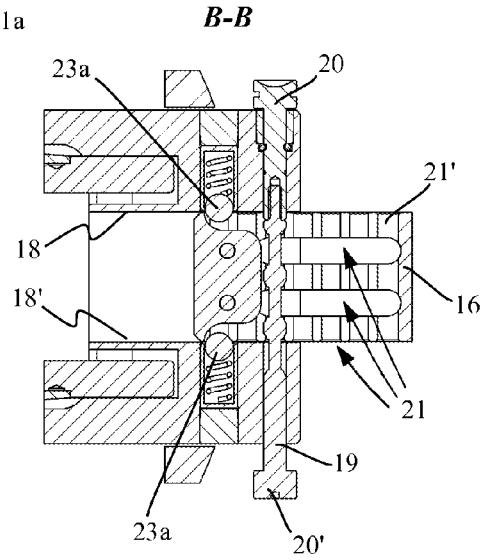

The features of the invention will become clearer upon reading a description of a preferred embodiment, given purely by way of non-limiting example, with reference to the schematic drawings, in which:

FIG. 1 is an exploded view of the clasp comprising an extensible buckle for a watch strap in accordance with the preferred embodiment of the invention, FIG. 2 is a side view of the clasp in which the tie for linking to a second strand of the wrist strap is in a first indexed position, FIG. 3 is a sectional view of FIG. 2 along A-A, FIG. 4 is a side view of the locked clasp, in which said tie is in a second indexed position, and FIG. 5 is a sectional view of FIG. 4 along B-B.

In accordance with the preferred embodiment of the invention as shown in FIGS. 1 to 5, the clasp comprising an extensible buckle comprises a first and a second strip 10, 11 which are articulated to one another at a first end. A hood 12 is articulated to a second end of the first strip 10 and below which a pin is arranged which can be linked to a first strand of the wrist strap. A tie 13, which can be linked to a second strand of the wrist strap, is connected to a cradle 16 which is in the form of a straight tile (FIG. 1). This cradle 16 is arranged in a housing 17 of a matching shape, which is located at a second end of the second strip 11. More specifically, the housing 17 is centred with respect to the lateral ends of this second strap 11. The end of the arms 11*a*, 11*b* of this second strip 11 extends perpendicularly towards the inside so as to form two opposite walls 18, 18' (FIG. 5) along which the cradle 16 can slide.

The clasp according to the invention further comprises a tab 19 which is arranged so as to pass perpendicularly through the end of one of the two arms 11*a*, 11*b* of the second strip 11 and the cradle 16. A first push-button 20 is arranged so as to pass perpendicularly through the end of the other of the two arms 11*a*, 11*b* and comprises a tubular part in which one end of the tab 19 is driven. The other end of the tab 19 comprises a part 20' serving as a second push-button. The tab 19 can occupy two axial positions in such a way that the cradle 16 is locked and unlocked when the tab 19 is located respectively in one and the other of the two axial positions thereof.

The cradle 16 comprises six notched parts 21, namely three lower notched parts (FIGS. 3 and 5) and three upper notched parts (not shown), each comprising a series of depressions 21' of a particular radius of curvature. Four of the six notched parts 21 are located along the edges of the cradle 16 facing the walls 18, 18' of the housing 17. More specifically, in the view of FIG. 3, each lateral edge of cradle 16 comprises two notched parts 21*a*, 21*b* which are arranged facing one another. The two remaining notched parts 21 are located facing one another at the central part of the cradle 16 in its axis of displacement.

The tab 19 comprises three bulges 22*a*, 22*b*, 22*c* which are arranged in three axial positions in such a way that each bulge 22*a*, 22*b*, 22*c* can be received in two depressions 21' of two corresponding opposite notched parts so as to lock the cradle 16 in an indexed position when the tab 19 is located in one of the two axial positions thereof. Each bulge 22*a*, 22*b*, 22*c* is disengaged from the two opposite notched parts when the tab 19 is located in the other of the two axial positions thereof, in such a way that the cradle 16 is unlocked and in such a way that it can be displaced with respect to said tab 19.

By virtue of the profile of the notched parts 21*a*, 21*b* which are arranged on the edges of the cradle 16 facing the walls 18, 18' of the housing 17, these edges comprise a series of receptacles which are each formed by two opposite depressions (21) and can receive a bead 23*a* of a catch 23, said bead being mounted on a spring 23*b*. The catches 23 are arranged in a piercing 25 formed on either side of the lateral edges of the second strip 11 and open onto the housing 17 in such a way that the bead 23*a* can be positioned in one of the receptacles. The purpose of the catches 23 is to position the cradle 16 in one of the indexed positions before actuating the tab 19 so as to lock the cradle 16 in one of the indexed positions.

The first push-button 20 is located in contact with one of the external flanks of the second strip 11 when the tab 19 occupies one of the two axial positions whereas the second push-button 20' is arranged so as to be located at a particular distance from the other of the external flanks of the second strip 11 (FIG. 5). A pressure exerted on the second push-button 20' thus makes it possible to actuate the tab 19 in translation in such a way that it occupies the other of the two axial positions thereof when the second push-button 20' is located in contact with the other of the external flanks of the second strip 11 (FIG. 3).

This clasp for a wrist strap is specially adapted for use in relation for watches, but it could equally well be used for any other object carried on the wrist.

The invention claimed is:

1. A clasp comprising an extensible buckle for a wrist strap making it possible to adjust the length of the wrist strap, said clasp comprising:

a first strip and a second strip (10, 11) which are articulated to one another at a first end, a first tie (12*a*) which is arranged at a second end of the first strip (10) for connection to a first strand of the wrist strap, a second tie (13) which is arranged at a second end of the second strip (11) for connection to a second strand of the wrist strap, indexing means whereby the second tie (13) can occupy different indexed positions with respect to the second end of the second strip (11), characterised in that the second tie (13) is connected to a cradle (16) which is arranged in a housing (17) located on the second strip (11), the housing (17) comprising two opposite walls (18, 18') along which the cradle (16) can slide, and in that the clasp further comprises a tab (19) which is connected to the second strip (11) and arranged so as to cooperate with the cradle (16), the tab (19) being able to occupy a first and a second axial position in such a way that the cradle (16) is locked in one of the indexed positions when the tab (19) is located in the first axial position thereof, and in such a way that the cradle (16) is unlocked when the tab (19) is positioned in the second axial position, in such a way that said cradle (16) can slide along the walls (18, 8') of the housing (17) so as to occupy a different indexed position, the cradle (16) being locked in said different indexed position when the tab (19) is displaced into the first axial position thereof again, and wherein the tab (19) is arranged so as to pass through the second strip (11) and the cradle (16) from one side to the other in a direction perpendicular to the displacement of said cradle (16).

2. The clasp according to claim 1, characterised in that a first and a second push-button (20, 20') are arranged at one end and the other end of the tab (19) respectively, the first push-button (20) being arranged so as to be contact with one of the external flanks of the second strip (11) when the tab (19) is located in one of the two axial positions thereof, whilst the second push-button (20') is arranged so as to be located at a particular distance from the other of the external flanks of the second strip (11) in such a way that a pressure exerted on the second push-button (20') makes it possible to actuate the tab (19) in translation so as to bring it from one to the other of the two axial positions thereof.

3. The clasp according to claim 1, characterised in that the cradle (16) comprises at least one notched straight part (21) arranged in the direction of the displacement of said cradle (16) and comprising a series of depressions (21'), and in that the tab (19) comprises at least one bulge (22*a*, 22*b*, 22*c*) which is arranged so as to be received in one of the depressions (21') so as to lock the cradle (16) in an indexed position when the tab (19) is located in one of the two axial positions thereof, the bulge or bulges (22*a*, 22*b*, 22*c*) being disengaged from the notched part or parts (21) of the cradle (16) when the tab (19) is located in the other of the two axial positions thereof in such a way that the cradle (16) can be displaced with respect to said tab (19).

4. The clasp according to claim 3, characterised in that the cradle (16) comprises, along each of the lateral edges thereof, two notched parts (21*a*, 21*b*) which are opposite one another, and in that the tab (19) comprises two bulges (22*a*, 22*c*), each bulge (22*a*, 22*c*) being arranged so as to be received in two opposite depressions (21') of the two notched parts (21*a*, 21*b*) arranged on each lateral side of the cradle (16).

5. The clasp according to claim 1, characterised in that two catches (23) are arranged on each of the two opposite walls (18, 18') of the housing (17) so as to cooperate with the cradle (16) so as to pre-position said cradle (16) in one of the indexed positions before displacing the tab (19) from one to the other of the two axial positions thereof so as to lock the cradle (16).

6. The wrist strap comprising the clasp according to claim 1.

7. The watch comprising the wrist strap according to claim 6.

* * * * *